US005487543A

United States Patent [19]

Funk

[11] Patent Number: 5,487,543

[45] Date of Patent: Jan. 30, 1996

[54] SHOT PEENED GOLF CLUB HEAD

[76] Inventor: Charles R. Funk, 6202 N. Camino De Santa Valera, Tucson, Ariz. 85718

[21] Appl. No.: 386,263

[22] Filed: Feb. 9, 1995

[51] Int. Cl.[6] ..... A63B 53/04

[52] U.S. Cl. ..... 273/78; 273/167 J

[58] Field of Search ..... 273/167 R, 77 R, 273/167 J, 78, 175; 72/53; 29/446

[56] References Cited

U.S. PATENT DOCUMENTS

| | | | |
|---|---|---|---|
| 2,908,502 | 10/1959 | Bradstreet | 273/167 J |
| 2,954,231 | 9/1960 | MacIntyre | 273/164.1 |
| 3,638,464 | 2/1972 | Winter . | |
| 4,768,787 | 9/1988 | Shira | 273/175 |
| 5,029,865 | 7/1991 | Kim | 273/167 J |
| 5,049,165 | 9/1991 | Tselesin . | |
| 5,190,289 | 3/1993 | Nagai | 273/167 J |
| 5,352,305 | 10/1994 | Hester . | |

*Primary Examiner*—Sebastiano Passaniti
*Attorney, Agent, or Firm*—Connolly & Hutz

[57] ABSTRACT

Metallic golf club heads are improved by a treatment which involves shot peening the exposed ball striking surface of the metal head without creating any noticeable change in appearance of the head. As a result of the shot peening treatment there is improved feel with minimal vibrational feel in the hands of the user when the user strikes a golf ball thus providing better control and increased distance of the shots.

10 Claims, 3 Drawing Sheets

□ Regular Shot (45-52$R_C$)
• Hard Shot (55-62$R_C$)

SHOT PEENED GOLF CLUB HEAD

BACKGROUND OF THE INVENTION

Various techniques have been attempted to improve the structure of golf clubs, such as in the head or shaft for maximizing the performance of the club. The present invention is directed to improvements in the mechanical properties of golf club heads and more particularly metal heads.

SUMMARY OF THE INVENTION

An object of the invention is to improve the performance of a golf club head by increasing the surface hardness and compressive stress of the ball striking surface.

A further object of this invention is to provide such a method of improving a golf club head to obtain better feel with minimal vibration feel in the hands of the user when striking the ball. In addition, the user would have better control of shots with increased distance.

In accordance with this invention performance of a golf club head is achieved by shot peening the metal head face. Preferably the shot used in the peening step is of greater hardness than that of the exposed head surface. As a result of the invention the shot peening increases the metal density and develops residual compressive stress while increasing hardness of the club head face without any substantial change in appearance of the exposed surface.

In the preferred practice of this invention the shot used in the peening has a hardness in the range of 55–62 Rc. The shot peening preferably has a peening intensity of 0.010–0.018A and more preferably 0.010–0.014A. As a result of the shot peening the head face subsurface has compressive stress at a depth of 0.0005 to 0.002 inches.

DETAILED DESCRIPTION

The present invention involves subjecting the face or exposed ball striking surface of a golf iron club head to a very high intensity shot peening to develop an increase in surface hardness and a compressive stress of the surface. These properties are developed by a very high peening intensity.

Figure 1:
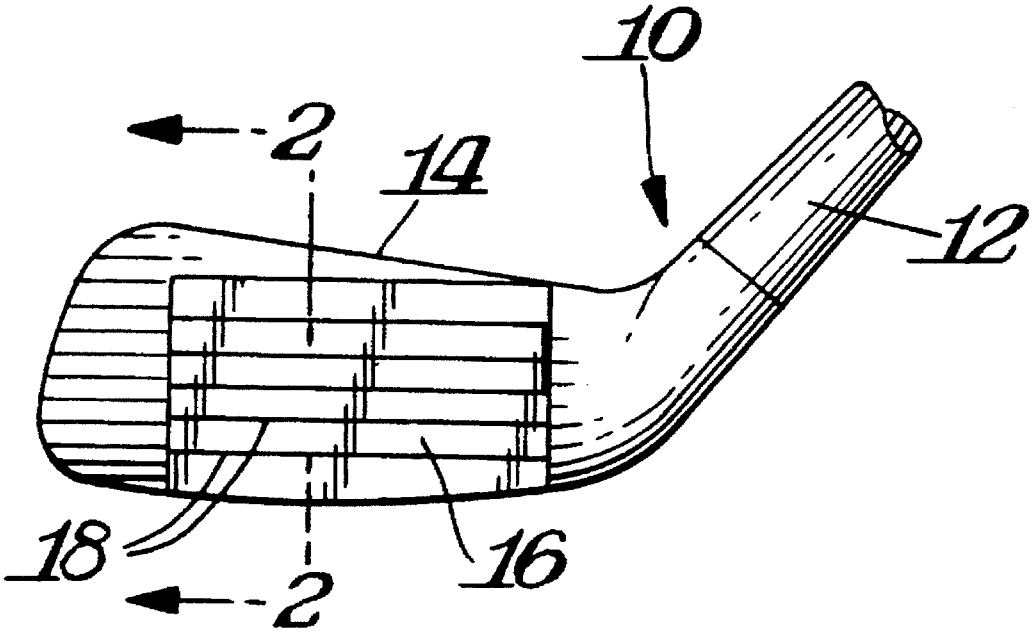
FIG. 1 is a side elevational view of a golf club head formed in accordance with this invention.
Figure 2:
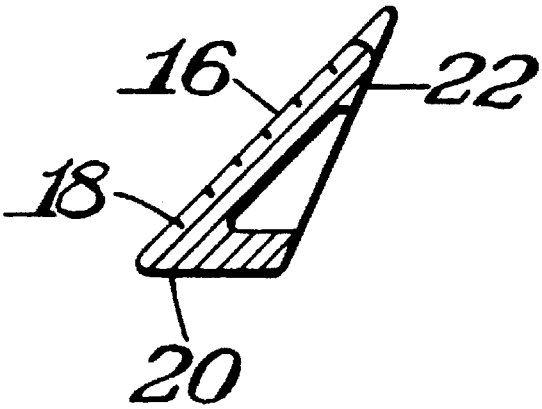
FIG. 2 is a cross-sectional view taken through FIG. 1 along the line 2—2.

FIGS. 1–2 illustrate a golf club 10 having a shaft 12 and a head 14 with an exposed ball striking surface 16. Surface 16 includes a plurality of parallel, horizontal grooves 18. FIG. 2 illustrates a toe portion 20 and a heel portion 22. The illustrated club 12 is a number 5 or number 6 golf club head. It is to be understood that the illustrated club is merely for exemplary purposes. The invention may be used with any golf club head and preferably with a metal head.

One of the advantages of the invention is that the shot peening process does not result in any appreciable change in appearance of the head. Treated golf club head with improved mechanical properties should fall within USGA rules.

Although some peening has previously been used to clean and/or roughen the surface, the invention represents the first use of shot peening to work harden the club head face and develop a compressive stress. In the manner described hereinafter which results in an improvement of the mechanical properties of the club head. In particular, the peening process develops a compressive stress of the surface by cold working the surface of the club face which is a distinctive feature of the invention.

Figure 4:
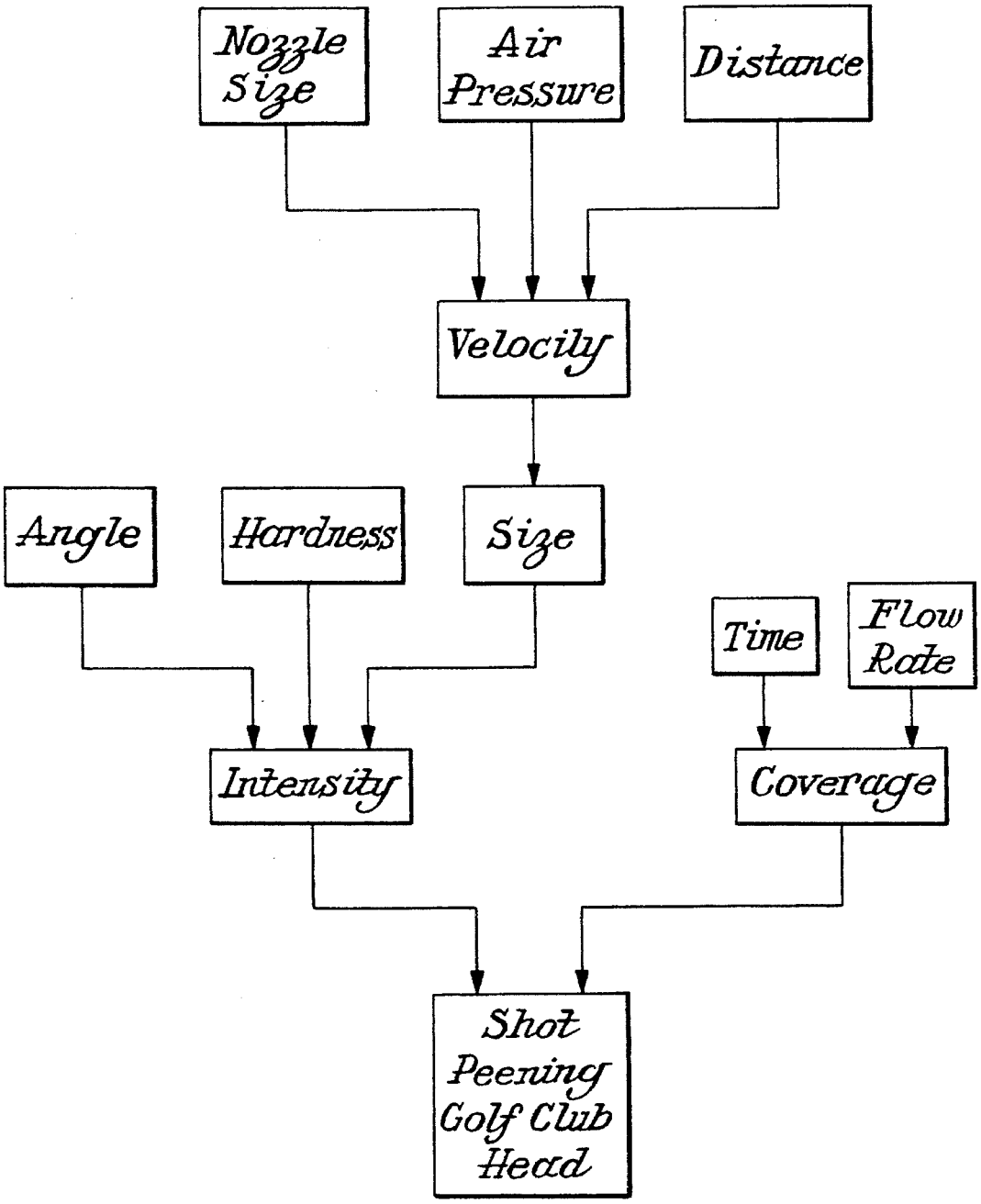
FIG. 4 is a block diagram showing the steps involved in the practice of the method of this invention.

FIG. 4 schematically illustrates in block diagram form the steps utilized to perform the shot peening operation. As indicated therein the nozzle size, the air pressure and the distance would determine the velocity of the shot. The velocity in accordance with the size of the shot and the hardness and angle would determine the intensity of the shot. The time of applying the shot and the flow rate would determine the area coverage. The area coverage and intensity would thus result in the peening of the exposed ball striking surface of the club head.

Significantly, the shot peening process of this invention can be such that no noticeable change in club face appearance results. Thus, the process does not make a rough surface or otherwise alter the geometric features of the ball striking surface. Tests on a number 4 iron, two number 5 irons and a complete set of club heads treated in accordance with the invention were shown to a technical expert from a pro group who did not believe that the heads had been given any type of treatment. A number of golf pros who tested the treated clubs also saw no difference in the club face smoothness. Others who have seen the treated clubs in test use on a golf course have also expressed disbelief that the clubs have been treated.

The shot peened club head of this invention provides the user with better control of his shots with increased distance. It is also possible for the user to eliminate one club by, for example, using a number 7 iron instead of a number 6 iron.

As indicated in the preferred practice of the invention, the golf club head should be made of metal. The invention could be used on various types of clubs, such as driving clubs, irons and putters. The peening process in accordance with this invention results in an improved golf club head whereby the player obtains better feel with no vibrational feel in the hand when striking the ball. In addition, the player has easier and better control of the shots with improved distance.

The shot peening operation results in increasing metal density, developing compressive residual stress and increasing the subsurface hardness of the club head face.

The shot peening technique of this invention is the utilization of known techniques which provide a method of cold working in which compressive forces are induced in the surface layer of a metal, in this case, a metallic club head face without changing the surface appearance. The peener operates within tolerance limits that insure that the correct stress profile is obtained. Peening intensity and shot size are the dominant factors in the stress profile.

The present invention makes use of the shot peening characteristics, such as using the process to enhance the fatigue characteristics of metal components. By the shot peening method there is a cold working of the metal in which compressive forces are induced in the surface layer by the impingement of a stream of shot. The shot peening also reduces the coefficient of friction which may be a factor in improving the club head.

In a practice of this invention a shot peening treatment of club heads used a shot size of MI-170 with a shot hardness of 55–62 Rc. The shot coverage was 200%. This percentage of coverage makes the club face surface smooth. Heads peened by the invention showed no visual evidence of peening.

The shot size, the shot hardness and coverage are specified to control surface finish. Shot hardness also assures the shot is harder than the metal club head and the Almen strip.

Preferably a high carbon cast steel shot is used.

The peening intensity is preferably in the range of 0.10–0.18A and more preferably 0.10–0.14A. The intensity measurement includes the gage reading and the standard "A" Almen test strip. The intensity is expressed as the arc-type of a shot peen Almen test strip. A velocity of projection is selected to obtain the desired intensity.

The density of the shot in a practice of the invention was not less than 7 gm/cc which was sufficient to obtain the required arc height of the test strip. The Shot Impact Angle (and Almen strip angle) is perpendicular to the club face during peening.

The Almen Intensity determines the depth of the residual compressive layer. The harder shot, projected at higher speeds, results in increased depth and magnitude of compression on the surface and subsurface and will produce a significant increase on surface hardness.

Figure 3:
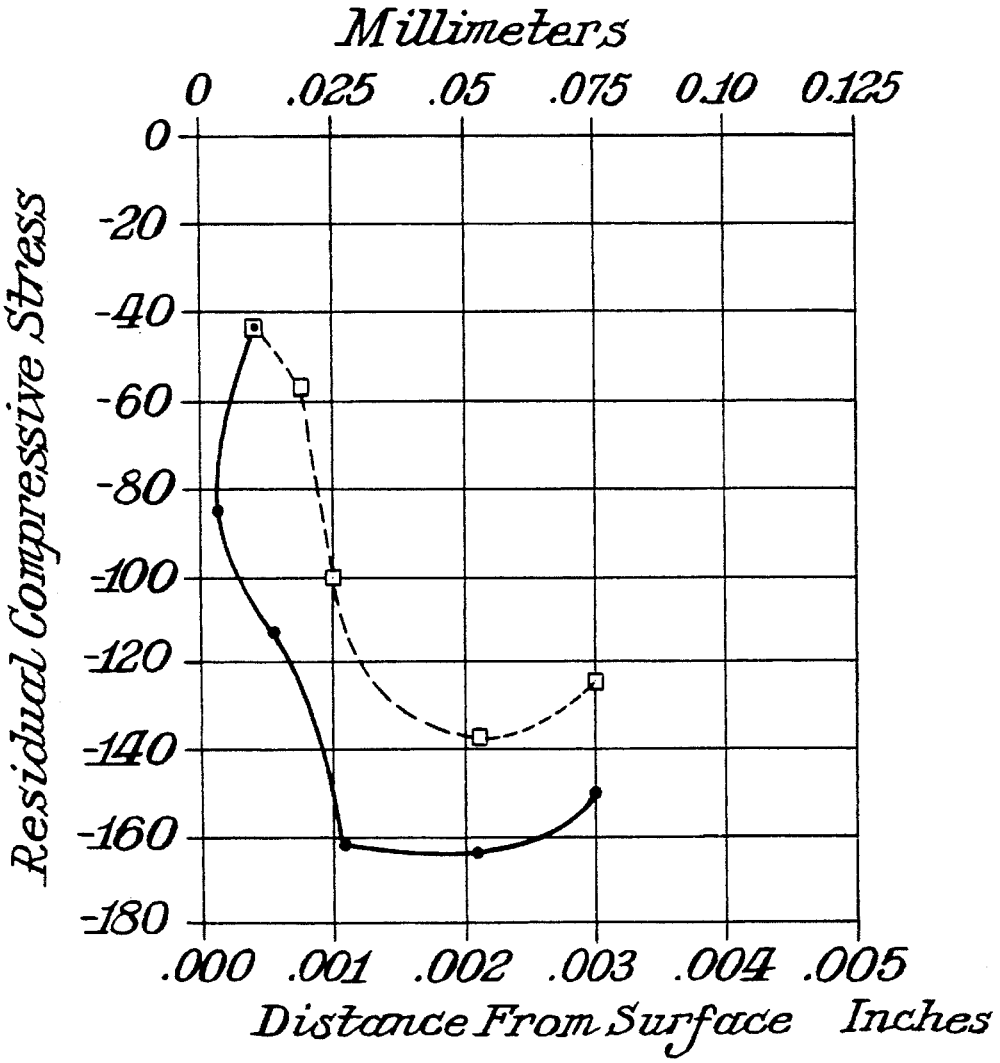
FIG. 3 is a graph showing residual compressive stress in accordance with the distance below the surface.

The use of the invention results in reduced coefficient of friction which may be because the treated surface of the club head face is in a compressive stress condition. FIG. 3 is a graph showing the residual compressive stress in accordance with the distance below the surface. As shown therein, the head face subsurface has a residual compressive stress at a depth of 0.0005 and 0.002 inches (0.013 and 0.05 mm).

The invention is particularly advantageous in that it utilizes a treatment which improves the mechanical properties of a golf club head without affecting the appearance of the head. Thus, the treated golf club could be used by both professionals and amateurs without requiring any change in playing techniques while obtaining improved results.

What is claimed is:

1. In a method of manufacturing a golf club having a metal head with a metal ball striking surface the improvement being in that the metal head is mounted with its metal ball striking surface exposed, shot peening the exposed metal ball striking surface of the club head to improve feel with minimal vibrational feel in the hands of the user when the user strikes a golf ball with the club head, and the shot peening work hardening the surface of the club head and creating a compressive stress.

2. The method of claim 1 wherein the shot used in the shot peening has a hardness greater than that of the exposed surface.

3. The method of claim 2 wherein the shot peening increases the metal density and develops residual compressive stress and increases hardness of the club head without any substantial change in appearance of the exposed surface.

4. The method of claim 3 wherein the shot used in the shot peening has a hardness in the range of 55–62 Rc.

5. The method of claim 4 wherein the shot peening has a peening intensity of 0.010–0.018A.

6. The method of claim 5 wherein the peening intensity is in the range of 0.010–0.014A.

7. The method of claim 6 wherein the shot peening reduces the coefficient of friction of the exposed surface.

8. The method of claim 7 wherein the shot peening results in the head face subsurface having a compressive stress at a depth of 0.0005 to 0.002 inches.

9. The method of claim 1 wherein the shot peening work hardens the ball striking surface without any substantial change in appearance of the ball striking surface.

10. A treated golf club made by a method which includes providing a golf club having a metal head with an exposed metal ball striking surface which is shot peened to improve feel with minimal vibrational feel in the hands of the user when the user strikes a golf ball with said ball striking surface, and with the shot peening work hardening said exposed metal ball striking surface and creating a compressive stress in said ball striking surface.

* * * * *